US010376036B2

(12) United States Patent
Uresti et al.

(10) Patent No.: US 10,376,036 B2
(45) Date of Patent: Aug. 13, 2019

(54) APPLICATOR FOR A COSMETIC PRODUCT AND ASSOCIATED APPLICATOR ASSEMBLY

(71) Applicant: ALBEA SERVICES, Gennevilliers (FR)

(72) Inventors: Osvaldo Uresti, Paris (FR); Camille Schreiber, Paris (FR)

(73) Assignee: ALBEA SERVICES, Gennevilliers (FR)

( * ) Notice: Subject to any disclaimer, the term of this patent is extended or adjusted under 35 U.S.C. 154(b) by 240 days.

(21) Appl. No.: 14/913,788

(22) PCT Filed: Jul. 24, 2014

(86) PCT No.: PCT/EP2014/065987

§ 371 (c)(1),
(2) Date: Feb. 23, 2016

(87) PCT Pub. No.: WO2015/028216

PCT Pub. Date: Mar. 5, 2015

(65) Prior Publication Data

US 2016/0206080 A1 Jul. 21, 2016

(30) Foreign Application Priority Data

Aug. 29, 2013 (FR) ..... 13 58285

(51) Int. Cl.
*A45D 40/26* (2006.01)
*A46B 9/02* (2006.01)

(52) U.S. Cl.
CPC ..... *A45D 40/267* (2013.01); *A46B 9/021* (2013.01); *A46B 2200/1053* (2013.01)

(58) Field of Classification Search
CPC .. A45D 40/262; A45D 40/264; A45D 40/265; A45D 40/267; A46B 9/021; A46B 2200/1053
See application file for complete search history.

(56) References Cited

U.S. PATENT DOCUMENTS 7,314,050 B2 1/2008 Hartstock et al.
D631,668 S 2/2011 Limongi
(Continued)

FOREIGN PATENT DOCUMENTS

FR 2961384 A1 12/2011
FR 2983689 A1 6/2013
WO 2011161584 A1 12/2011

OTHER PUBLICATIONS

Sep. 18, 2014—International Search Report of PCT/EP2014/065987.

*Primary Examiner* — Rachel R Steitz
(74) *Attorney, Agent, or Firm* — Banner & Witcoff, Ltd.

(57) ABSTRACT

The invention relates to a cosmetic product applicator (10) with a core (12) having a first end, called proximal end (13), and a second free end, called distal end (16), and a plurality of protuberances (30) protruding from the core (12). The protuberances (30) are molded with the core (12) and are arranged in a plurality of rows extending in the extension direction (Y) of a sleeve (14) extending the core (12). The free ends of said protuberances (30) form two separate enclosures, a first of said enclosures having an outer bulk smaller than that of the second enclosure (E2). The number of rows, called first rows, forming the first enclosure being smaller than the number of rows, called second rows, forming the second enclosure (E2). The invention also related to an associated applicator assembly.

10 Claims, 2 Drawing Sheets

(56) References Cited

U.S. PATENT DOCUMENTS

Figure 1:
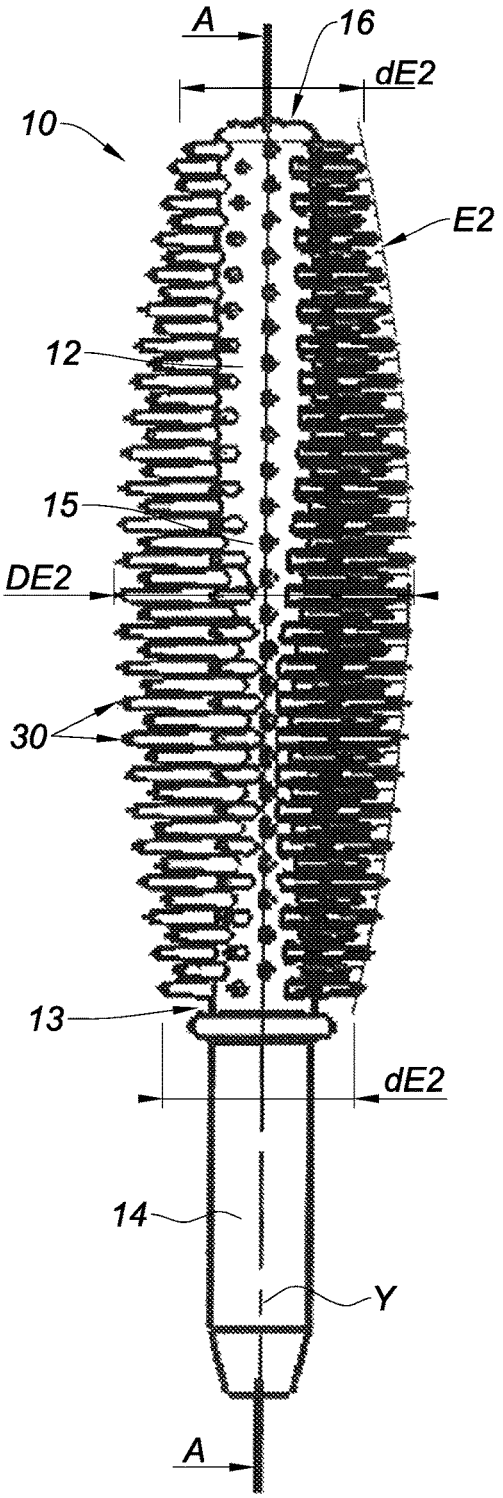

| | | | | |
|---|---|---|---|---|
| 2012/0174941 | A1 | 7/2012 | Gueret | |
| 2013/0315647 | A1 * | 11/2013 | Gueret | A45D 40/265<br>401/122 |

* cited by examiner

APPLICATOR FOR A COSMETIC PRODUCT AND ASSOCIATED APPLICATOR ASSEMBLY

CROSS-REFERENCE TO RELATED APPLICATIONS

The present application is a U.S. National Phase filing of International Application No. PCT/EP2014/065987, filed on Jul. 24, 2014, designating the United States of America and claiming priority to French Patent Application No. 1358285 filed Aug. 29, 2013. The present application claims priority to and the benefit of all the above-identified applications, which are all incorporated by reference herein in their entireties.

The invention relates to a cosmetic product applicator and to an associated applicator assembly.

Applicator assemblies for cosmetic products, in particular for cosmetic products to be applied to the eyelashes, such as mascara, comprising a container containing the cosmetic product and an applicator sub-assembly which can be removably attached to the container, are known.

The container generally comprises a body, the body comprising walls delimiting a reservoir in which the cosmetic product is contained, and a neck defining an opening through which the cosmetic product can be removed.

The applicator sub-assembly generally comprises a cap which can be attached to the neck, a rod extending from the cap and an applicator attached to a free end of the rod. The applicator comprises a core and a plurality of protrusions or bristles extending from the core.

When the cap is attached to the neck, the rod and the applicator extend within the reservoir. The applicator is immersed in the cosmetic product contained in the reservoir.

To use the applicator, the user detaches the cap from the neck and removes the applicator from the container.

To prevent the applicator from being overloaded with cosmetic product, the container generally comprises a wiper, attached to the interior of the neck. When the user removes the applicator from the container, the applicator and the rod slide within the wiper. The wiper scrapes off the excess cosmetic product on the rod and on the applicator.

The wiper thus makes it possible to control the amount of product which is on the applicator and prevents an excessive amount of cosmetic product from being applied to the eyelashes.

The wiper in particular limits the amount of product present on the protrusions. Two parameters interact for this purpose: the internal diameter of the wiper and the radial extension of the protrusions. The radial extension of a protrusion means the distance between the axis of longitudinal extension of the core and the free end of the protrusion.

Thus, the desired amount of product on the protrusions when leaving the wiper results from the compromise between the internal diameter of the wiper and the radial extension of the protrusions.

Moreover, it is known that the regions having protrusions having a shorter radial extension promote the loading of the applicator with product, whereas the regions having protrusions having a longer radial extension promote the combing of the eyelashes.

The problem addressed by the present invention is that of allowing the eyelashes to be both combed and loaded with an appropriate amount of cosmetic product.

Therefore, the invention relates to an applicator for a cosmetic product, comprising a core having a first end, referred to as a proximal end, and a second, free end, referred to as a distal end, and a plurality of protrusions projecting from the core.

According to the invention, said protrusions are moulded with the core and are arranged in a plurality of rows extending in the extension direction of a cylindrical coupling which extends the core, and the free ends of said protrusions form two separate envelopes, a first of said envelopes having an external size that is less than that of the second envelope, the number of rows, referred to as first rows, forming the first envelope being lower than the number of rows, referred to as second rows, forming the second envelope.

The proposed applicator has the advantage of allowing the eyelashes to be simultaneously combed and loaded with cosmetic product in accordance with an advantageous compromise allowing some of the rows which are used for combing to be consecutive in an angular manner. This applicator is all the more advantageous since it allows these simultaneous functions over its entire length.

According to various embodiments of the invention, which may be taken together or separately:

- the core has a longitudinal extension which has a first portion that is curved from the proximal end to a central portion of the applicator and a second portion that is curved from said central portion to the distal end,
- the curvatures of the first and the second portion of said axis are opposite, so as to give the core an S-shape,
- said first and second envelopes are homothetic with respect to one another; in other words, they follow the same profile, and only the amplitude of the profile changes,
- said rows are parallel to the axis of longitudinal extension of the cylindrical coupling,
- said rows are radially spaced around the periphery of the core at a constant angular distance,
- said angular distance is 30°,
- the number of second rows is two to six, in particular four, times greater than the number of first rows,
- the protrusions have a semi-circular cross section,
- the protrusions each extend along a normal to the axis of longitudinal extension of said cylindrical coupling,
- the protrusions are rectilinear,
- the protrusions each have a planar surface, the protrusions being positioned such that planar surfaces of two adjacent protrusions are oriented in the same rotational direction,
- the protrusions in two adjacent rows are axially offset from one another,
- the core has a constant cross section,
- the core is made of plastics material,
- the protrusions are made of plastics material,
- the core and the protrusions are moulded from the same material,
- the core is solid,
- the applicator forms a brush.

The invention also relates to an applicator assembly for a cosmetic product which comprises a container comprising a body which forms a reservoir intended to contain the cosmetic product, and an applicator as described above, which can be attached to the container such that said applicator is housed within the reservoir.

Advantageously, said container comprises a wiper, said wiper having an internal diameter of which the value is between the maximum external size of the first envelope and the maximum external size of the second envelope.

Figure 2:
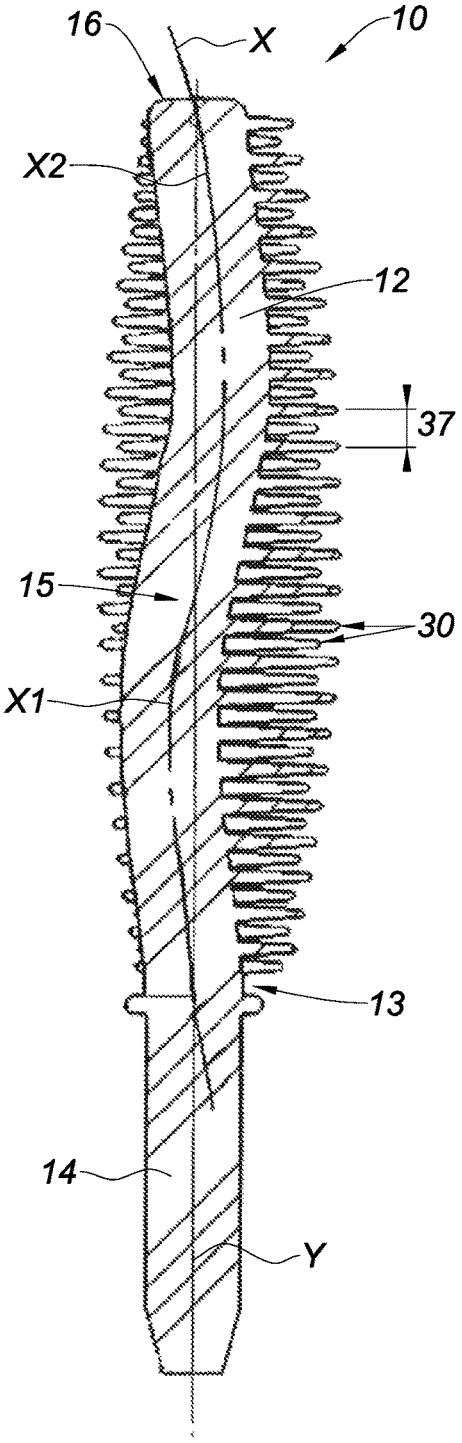
Figure 3:
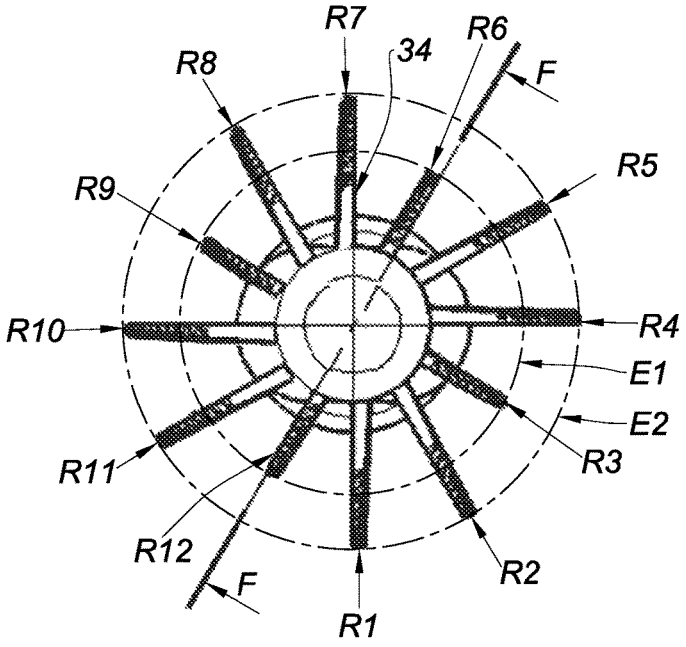
Figure 4:
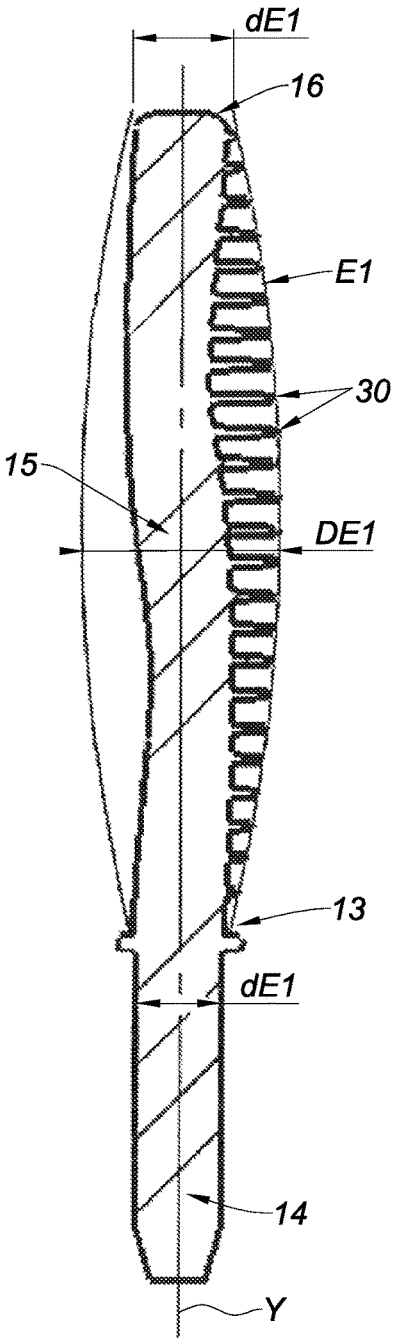

The invention will be better understood and other aims, details, features and advantages thereof will become more clearly apparent in the following detailed explanatory description of at least one embodiment of the invention given as a purely illustrative and non-limiting example, with reference to the accompanying schematic drawings, in which:

FIG. 1 is a view in elevation of an embodiment of an applicator according to the invention, FIG. 2 is a cross section along line A-A shown in FIG. 1, FIG. 3 is a plan view of the same embodiment of the invention, and FIG. 4 is a cross section along line F-F shown in FIG. 3.

FIG. 1 shows an embodiment of an applicator 10 according to the invention. Said applicator 10 comprises a core 12 having a first end, referred to as a proximal end 13, and a second, free end, referred to as a distal end 16, and a plurality of protrusions 30 projecting from the core 12. The core 12 is also extended in this case by a cylindrical coupling 14 for attaching the applicator 10, extending from the proximal end 13 of the core 12.

The cylindrical coupling 14 has an axis of longitudinal extension, which is provided with reference sign Y in the drawings. The core 12 also has a longitudinal extension, provided with reference sign X, in particular in FIG. 2, and is advantageously curved, as is discussed in greater detail below.

The protrusions 30 are moulded with the core 12. In other words, the protrusions 30 may be integrally formed with the core 12 or over-moulded on the core 12. This provides useful options in terms of the shapes for the core 12 or for said protrusions 30. For example, the core 12 is S-shaped when it is viewed from a certain angle. Still by way of example, said protrusions 30 may have different heights. The height of a protrusion 30 means the distance between the periphery of the core 12 and the free end of the protrusion 30.

S-shaped means that the core 12 has a first portion X1 that is curved from the proximal end 13 to a central portion 15 of the applicator 10 and a second portion X2 that is curved from said central portion 15 to the distal end 16 (see FIG. 2).

The curvature of the first portion X1 is opposite to the curvature of the second portion X2.

Preferably, the core 12 has a substantially circular cross section from its proximal end 13 to its distal end 16. This embodiment is not limiting, and the core 12 could also have a polygonal cross section. Cross section of the core 12 means a section that is made in a plane which is orthogonal to its extension direction X.

The core 12 is provided so as to be solid. It is also possible, in another embodiment which is not shown, for the core 12 to be hollow.

The protrusions 30 form envelopes with their free ends. The free end of a protrusion 30 means the end opposite that end by which it projects from the core 12.

In the present case, the protrusions 30 form a first and a second envelope E1, E2, which are each spindle-shaped. Said envelopes E1, E2 are shown in detail in FIGS. 1 and 4; they extend from the proximal end 13 to the distal end 16 of the core 12.

The S-shape of the core 12 described above does not influence the external size of said first and second envelopes E1, E2. In other words, the height of the protrusions 30 is provided in order to form envelopes E1, E2 which do not depend on the shape of the core 12 from which they project, by adapting said height.

The first envelope E1 has an external size that is less than that of the second envelope E2 (see FIG. 3).

In addition, the protrusions 30 are arranged in a plurality of rows R1-R12 that extend in the extension direction Y of the cylindrical coupling 14 of the core 12, in parallel with said direction Y.

According to the invention, the number of rows R3, R6, R9, R12, referred to as first rows, forming the first envelope E1 is lower than the number of rows R1, R2, R4, R5, R7, R8, R10, R11, referred to as second rows, forming the second envelope E2.

In the embodiment shown here, there are four first rows, while there are eight second rows. This example is not limiting, and the ratio of the number of second rows to the number of first rows is between two and six, and is preferably equal to four, as is the case here.

As mentioned above, the protrusions 30 have different heights. However, the radial extensions of the protrusions 30 belonging to the same row R1-R12 change in a selected manner. In the following, radial extension means the distance between the axis Y of longitudinal extension of the cylindrical coupling 14 and the free end of a protrusion 30.

The radial extensions of the protrusions 30 belonging to the same row R1-R12 change linearly, or in accordance with other variation profiles, from one protrusion 30 to another, for example by successive stages of at least two substantially identical protrusions 30.

The radial extensions of the protrusions 30 of the first and second rows R1-R12 increase progressively in length from the proximal end 13 towards the central portion 15 of the core 12, and then decrease progressively in length from said central portion 15 towards the distal end 16.

As shown in FIG. 4, the external size dE1, DE1 of the first envelope E1, formed by the protrusions 30 of the first rows R3, R6, R9, R12, has a diameter of between 2 and 7 mm. This size dE1 is substantially the same in the vicinity of the proximal end 13 and in the vicinity of the distal end 16, for example approximately 3 mm; whereas, in the vicinity of the central portion 15, this size DE1 may be approximately 6 mm.

As shown in FIG. 1, the external size dE2, DE2 of the second envelope E2, formed by the protrusions 30 of the second rows R1, R2, R4, R5, R7, R8, R10, R11, has a diameter of between 4 and 9 mm. This size dE2 is substantially the same in the vicinity of the proximal end 13 and in the vicinity of the distal end 16, for example approximately 5 mm; whereas, in the vicinity of the central portion 15, this size DE2 may be approximately 8 mm.

Therefore, these sizes respect the following formulas:

$$1.1 \leq \frac{DE2}{DE1} \leq 1.5 \text{ and } 1.4 \leq \frac{dE2}{dE1} \leq 2.2$$

The rows R1-R12 are shown in FIG. 3, which, as a reminder, is a plan view of the applicator 10 according to the embodiment in FIG. 1. In other words, in this example, the applicator comprises only rows of the first and the second type.

In addition, the rows R1-R12 are radially spaced around the periphery of the core 12 at a constant angular distance. This angular distance may vary from one embodiment to another. In the embodiment shown here, the angular distance is 30°. In other words, there are twelve rows R1-R12 here. Said angular distance may be within the range of 15° and 45°; the number of rows varies depending on the selected angular distance.

As described at the outset, the container of the applicator assembly according to the invention generally comprises a wiper, which is attached to the interior of the neck thereof in order to limit the amount of product on the protrusions 30, in particular on those protrusions having the greatest radial extensions. As a reminder, these protrusions thus serve to comb the eyelashes, whereas the teeth having the shortest radial extension, which are only wiped to a small extent, serve to load the eyelashes with product.

Therefore, the effect associated with alternating two types of rows of protrusions 30 is particularly advantageous. In a single gesture of rotating the applicator about the axis of longitudinal extension Y of the cylindrical coupling 14, it allows the user to benefit from a loading envelope, namely the first envelope E1 formed by the first rows R3, R6, R9, R12, and from a combing envelope, namely the second envelope E2 formed by the second rows R1, R2, R4, R5, R7, R8, R10, R11.

Since the number of second rows R1, R2, R4, R5, R7, R8, R10, R11 is greater than the number of first rows R3, R6, R9, R12, the applicator according to the invention is more dedicated to combing the eyelashes than to loading the eyelashes with cosmetic product.

The protrusions 30 in two adjacent rows are advantageously axially offset from one another. Offset means that the protrusions 30 in one row are axially offset from the protrusions 30 in the adjacent rows, said rows R1-R12 having substantially the same spacing 37 between their protrusions 30 of approximately one millimeter, for example (see FIG. 2). Therefore, over the same axial portion, the rows R1-R12 have the same number of protrusions 30, to within one protrusion 30 more or less, for example twenty protrusions 30.

Furthermore, said protrusions 30 preferably have a semi-circular cross section. The protrusions can thus be positioned so that the planar surfaces 34 of two adjacent protrusions 30 are oriented in the same rotational direction about the core 12 (see FIG. 3). This means that the protrusions 30 in a first row R3 all have a planar face 34 that is oriented radially in a first direction about the core 12, and that the planar faces 34 of the protrusions 30 in the rows R2 and R4 adjacent to the row R3, for example, are oriented in the same direction about the core 12. In other words, no planar face 34 is opposite another planar face 34.

Therefore, it is easy to mould said protrusions 30 with the core 12, because it allows the use of sliding mould cores which are simple in shape, all have substantially the same shape, and are all oriented radially in the same direction.

In this case, the protrusions 30 are rectilinear and furthermore can be substantially tapered from their base to their free end. In addition, said protrusions 30 each extend along a normal to the axis Y of the cylindrical coupling 14.

As mentioned above, the protrusions 30 are preferably integrally formed with the core 12. For example, the core 12 and the protrusions 30 can be moulded from a material based on LDPE (low-density polyethylene). Other materials may also be used, namely the material "Exact" from ExxonMobil or the material "Hytrel" from Dupont, or a mixture of these materials.

It should be noted that the applicator 10 advantageously forms a brush.

It should also be noted that said first and second envelopes E1, E2 are in phase, from the proximal end 13 to the distal end 16; in other words, they follow the same profile, and only the amplitude of the profile changes. In other words, they are homothetic.

Furthermore, the alternating nature of the first and second rows is produced, in the present example, by the circular permutation of a first row R3, R6, R9, R12 with two second rows R1, R2, R4, R5, R7, R8, R10, R11.

This example is not limiting, and it is possible to alternate, by circular permutation, a first row with three second rows, or two first rows with three second rows.

The invention also relates to an applicator assembly for a cosmetic product, comprising a container comprising a body which forms a reservoir intended to contain the cosmetic product, and an applicator sub-assembly which can be attached to the container such that the applicator 10 is housed within the reservoir. Said applicator 10 is attached, for example, to the end of a rod (not shown), the rod itself being attached to a cap that is advantageously screwed to the container. After assembly, the cylindrical coupling 14 is positioned in the rod and the proximal end 13 of the core forms the visible proximal end of the applicator.

As already mentioned, said container also comprises a wiper (not shown). This wiper has an internal diameter of which the value is between the maximum external size DE1 of the first envelope E1 and the maximum external size DE2 of the second envelope E2.

The wiping carried out by this wiper is therefore significant on the protrusions 30 belonging to the second envelope E2, and almost non-existent on the protrusions 30 belonging to the first envelope E1. This explains the particularly advantageous effect of the applicator 30 according to the invention, namely that of proposing an applicator that is more dedicated to combing the eyelashes than to loading the eyelashes with cosmetic product.

It should also be noted that variants are of course possible. In particular, in an additional embodiment, the applicator of the invention comprises a different number of rows, which is either lower (for example 9 rows) or higher (for example 18 rows).

The invention claimed is:

1. Applicator for a cosmetic product, comprising:

a core having a first end, referred to as a proximal end, and a second, free end, referred to as a distal end, and a plurality of protrusions projecting from the core, wherein the plurality of protrusions form a circular cross-section of the applicator;

wherein said protrusions are moulded with the core and are arranged in a plurality of rows extending in an extension direction (Y) of a cylindrical coupling which extends the core, and wherein free ends of said protrusions form two separate envelopes (E1, E2) each envelope being spindle-shaped, a first of said envelopes (E1) having an external size (dE1, DE1) that is less than that of a second of said envelopes (E2), the number of rows, referred to as first rows, forming the first envelope (E1) being lower than the number of rows, referred to as second rows, forming the second envelope (E2); and wherein the core has a longitudinal extension (X) which has a first portion (X1) that is curved from the proximal end to a central portion of the applicator and a second portion (X2) that is curved from said central portion to the distal end.

2. Applicator according to claim 1, wherein the curvatures of the first and the second portion (X1, X2) of said longitudinal extension (X) are opposite.

3. Applicator according to claim 1, wherein said first and second envelopes (E1, E2) are homothetic with respect to one another.

4. Applicator according to claim 1, wherein said rows are parallel to the axis of longitudinal extension (Y) of the cylindrical coupling.

5. Applicator according to claim 1, wherein said rows are radially spaced around the periphery of the core at a constant angular distance.

6. Applicator according to claim 5, wherein said angular distance is 30°.

7. Applicator according to claim 1, wherein the number of second rows is two to six times greater than the number of first rows.

8. Applicator according to claim 1, wherein the protrusions each have a planar surface, the protrusions being positioned such that planar surfaces of two adjacent protrusions are oriented in the same rotational direction.

9. Applicator assembly for a cosmetic product, comprising:

a container comprising a body which forms a reservoir intended to contain the cosmetic product, and an applicator according to claim 1, which can be attached to the container such that said applicator is housed within the reservoir.

10. Applicator assembly according to claim 9, wherein said container comprises a wiper, said wiper having an internal diameter of which the value is between the maximum external size (DE1) of the first envelope (E1) and the maximum external size (DE2) of the second envelope (E2).

* * * * *